US010538364B2

(12) United States Patent
Croft

(10) Patent No.: US 10,538,364 B2
(45) Date of Patent: Jan. 21, 2020

(54) LOCKING APPARATUS FOR CONTAINER

(71) Applicant: Sonoco Plastics, Inc., Hartsville, SC (US)

(72) Inventor: Brandon Croft, Springfield, MN (US)

(73) Assignee: Sonoco Plastics, Inc., Hartsville, SC (US)

( * ) Notice: Subject to any disclaimer, the term of this patent is extended or adjusted under 35 U.S.C. 154(b) by 554 days.

(21) Appl. No.: 15/268,210

(22) Filed: Sep. 16, 2016

(65) Prior Publication Data

US 2018/0079562 A1 Mar. 22, 2018

(51) Int. Cl.
*B65D 43/16* (2006.01)
*B65D 43/22* (2006.01)

(52) U.S. Cl.
CPC ..... *B65D 43/162* (2013.01); *B65D 43/22* (2013.01)

(58) Field of Classification Search
CPC .. B65D 2251/1033; B65D 2543/00194; B65D 43/162; B65D 43/22; Y10T 24/45775
USPC ..... 220/4.21–4.24, 834–835; 229/406; 24/662
See application file for complete search history.

(56) References Cited

U.S. PATENT DOCUMENTS 3,786,982 A 1/1974 Rakes et al.
4,512,474 A 4/1985 Harding
4,576,330 A 3/1986 Schepp
4,886,204 A 12/1989 Kalmanides
5,046,659 A 9/1991 Warburton
5,169,014 A * 12/1992 Hexamer ..... B65D 43/162 220/4.22
5,339,973 A 8/1994 Edwards et al.
5,497,894 A 3/1996 Krupa et al.
5,584,408 A 12/1996 Orkisz
5,693,388 A * 12/1997 Castner ..... B29C 51/32 206/521
5,947,321 A * 9/1999 Vadney ..... B65D 51/1611 220/326
7,284,673 B2 10/2007 Habeger et al.
8,091,731 B2 1/2012 Kidd et al.
2009/0134179 A1* 5/2009 Kidd ..... B65D 43/162 220/834

(Continued)

*Primary Examiner* — Anthony D Stashick
*Assistant Examiner* — Kaushikkumar A Desai
(74) *Attorney, Agent, or Firm* — Fish & Richardson P.C.

(57) ABSTRACT

A locking apparatus has a receiving component that includes outer sidewalls extending upward from a first surface to form a raised portion, the raised portion having a receiving surface within a periphery defined by the outer sidewalls, and inner sidewalls extending downward from the receiving surface to form a cavity within the raised portion, the cavity having a cross-sectional area that decreases in proportion to the downward extension of the inner sidewalls, and a first locking structure. The locking apparatus also has an insertion component that includes sidewalls extending upward from a second surface and defining a cross-sectional area that decreases in proportion to the upward extension of the sidewalls, and also includes a second locking structure that is operatively associated with the first locking structure so that when the insertion component is inserted into the receiving component the first locking structure and the second locking structure interlock.

8 Claims, 5 Drawing Sheets

(56) References Cited

U.S. PATENT DOCUMENTS

| | | | | |
|---|---|---|---|---|
| 2012/0031921 | A1* | 2/2012 | Cadiente | B65D 43/162<br>220/835 |
| 2012/0055816 | A1 | 3/2012 | Buchko | |

* cited by examiner

LOCKING APPARATUS FOR CONTAINER

BACKGROUND

Many food products are stored and shipped in lightweight plastic containers. Typically, a plastic container is constructed to facilitate automated packaging of the food products and includes a locking mechanism to lock a container lid over a base portion. Because the container is intended to be used for shipping and display after packaging, it is desirable that the locking mechanism stay securely locked during shipment and subsequent handling. However, locking mechanism that stay securely locked often are designed with relatively tight fitting interlocking structures. While such tight fitting interlocking structures provide a secure lock, they require relatively consistent alignment of the interlocking structures to engage properly. While the container is being processed in an automated food packing line, however, misalignments between the interlocking components may occur, resulting in a locking mechanism that is not fully engaged. Containers with locking mechanisms that are not fully engaged are prone to opening, causing spillage and loss of the food products stored within.

SUMMARY

This specification describes technologies relating to a locking mechanism for a container, such as a food container. The locking mechanism is highly tolerant to misalignment of separate interlocking components during engagement such that it can securely lock over a wide range of misalignment between the components.

In general, one innovative aspect of the subject matter described in this specification can be embodied in a container apparatus that includes a base section defining a base surface and one or more sidewalls extending upward from the base surface to define a container portion having an upper base periphery; a base flange projecting outward from the upper base periphery; a lid section defining a lid surface and a lid periphery that aligns with the upper base periphery so that the lid surface and the container portion form an enclosure when the lid section is in a closed position relative to the base section; and a lid flange projecting outward from the lid periphery; wherein the lid flange and the base flange include respectively integrally formed locking components comprising: a receiving locking component extending from one of the base flange or lid flange, the receiving locking component comprising: outer sidewalls extending upward from the one of the base flange or lid flange to form a raised portion relative to the one of the base flange or lid flange, the raised portion having a receiving surface within a periphery defined by the outer sidewalls, inner sidewalls extending downward from the receiving surface to form a substantially trapezoidal prism cavity within the raised portion so that a cross-sectional area of the trapezoidal prism cavity decreases in proportion to the downward extension of the inner sidewalls, and a first locking structure; and an insertion locking component defined by sidewalls extending upward from the other of the base flange or lid flange and defining a substantially trapezoidal prism shaped rib so that a cross-sectional area of the insertion locking component decreases in proportion to the upward extension of the sidewalls, and wherein the insertion locking component includes a second locking structure that is operatively associated with the first locking structure so that when the insertion locking component is inserted into the receiving locking components the first locking structure and the second locking structure interlock.

In general, another innovative aspect of the subject matter described in this specification can be embodied in a locking apparatus that includes; a locking apparatus, comprising: a receiving locking component extending a first surface, the receiving locking component comprising: outer sidewalls extending upward from the first surface to form a raised portion relative to the first surface, the raised portion having a receiving surface within a periphery defined by the outer sidewalls, inner sidewalls extending downward from the receiving surface to form a cavity within the raised portion, the cavity having a cross-sectional area that decreases in proportion to the downward extension of the inner sidewalls, and a first locking structure; and an insertion locking component defined by sidewalls extending upward from a second surface and defining a cross-sectional area that decreases in proportion to the upward extension of the sidewalls, and wherein the insertion locking component includes a second locking structure that is operatively associated with the first locking structure so that when the insertion locking component is inserted into the receiving locking component the first locking structure and the second locking structure interlock.

Particular embodiments of the subject matter described in this specification can be implemented so as to realize one or more of the following advantages. The locking mechanism, being highly tolerant to misalignment of separate interlocking components during engagement, is more likely to be securely locked during packaging. This results in fewer openings of the container during packaging, shipping and display, resulting in fewer losses, which, in turns, results in a cost savings.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements. Reference numerals in drawings subsequent to the drawings in which they are introduced may be omitted to avoid congestion in the drawings.

DETAILED DESCRIPTION

A locking mechanism includes a receiving locking component and an insertion locking component. In the example implementation described below, the receiving locking component defines a trapezoidal prism shaped cavity, and the insertion locking component defines a trapezoidal prism shaped rib. The receiving locking component thus has a cavity that is of an initial cross-sectional area that is larger than a cross-sectional area of a top portion of the insertion locking component. This facilitates insertion of the insertion locking component into the receiving locking component over a wide range of misalignments between the two components. Each locking component has respective integrally formed locking structures that interlock when the insertion locking component is fully received by the receiving locking component.

While trapezoidal prism shapes are described in the examples below, other geometric shapes that have a proportional height reduction in cross sectional areas can also be used, such as a pyramid frustum.

These features and other features are described in more detail below.

Figure 1:
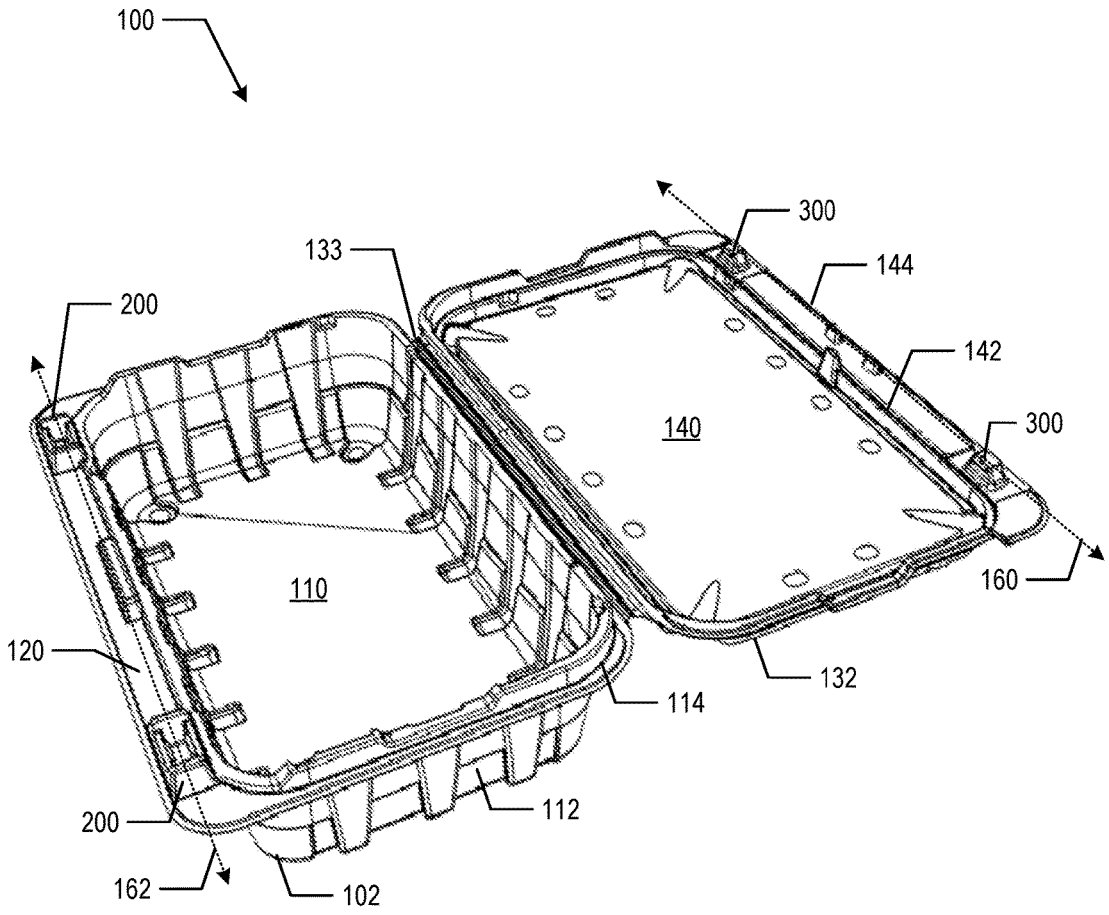
FIG. 1 is a top perspective view of an open container with a locking mechanism.

FIG. 1 is a top perspective view of an open container 100 with a locking mechanism that includes a receiving locking component 200 and an insertion locking component 300. In some implementations, the container 100 is made of polyethylene terephthalate (PET) thermoplastic polymer resin. Other appropriate materials may also be used to construct the container.

The container 100 includes a base section 102 defining a base surface 110 and one or more sidewalls 112 extending upward from the base surface 110 to define a container portion having an upper base periphery 114. A base flange 120 projects outward from the upper base periphery 114.

A lid section 132 defines a lid surface 140 and a lid periphery 144 that aligns with the upper base periphery 114 so that the lid surface 140 and the container portion form an enclosure when the lid section 132 is in a closed position relative to the base section 102. The lid sections 132 includes a lid flange 144 projecting outward from the lid periphery 142. Near respective corners of the container 100 are reciprocally-placed receiving components 200 and insertion components 300. As show in FIGS. 1-3, the receiving components are formed in the base flange 120, and the insertion components are formed in the lid flange 144. However, the receiving components 200 could instead be formed in the lid flange 144, and the insertion components 300 could be formed in the base flange 120. In yet another configuration, the lid flange 144 could have both a receiving component 200 and an insertion component 300, and the base flange 120 could have a receiving component 200 and an insertion component 300 that are reciprocally-placed relative to their counterparts.

Figure 2:
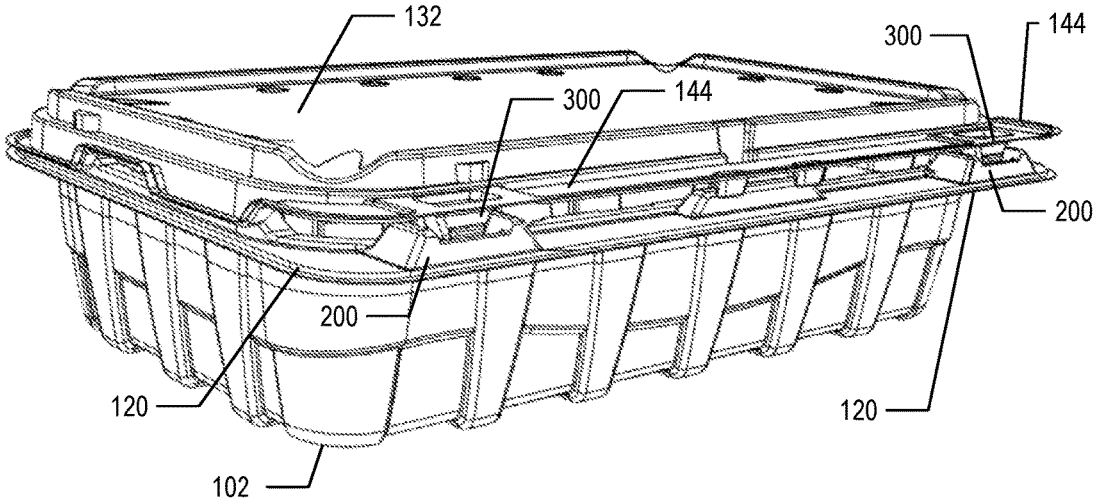
FIG. 2 is a top perspective view of the container of FIG. 1 in a partially closed position during which separate components of the locking mechanism are in initial engagement.
Figure 3:
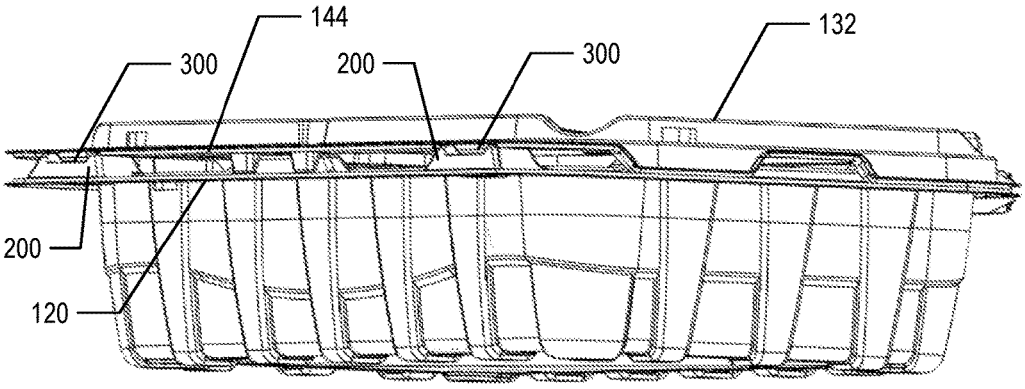
FIG. 3 is a side perspective view of the container in a closed positon with the locking mechanism fully engaged.

The lid section 132 and the base section 102 are flexibly connected, e.g., by a living hinge 133, so that the lid section 132 can rotate over the base section 102 to form the enclosure. FIGS. 2 and 3 depict the container 100 in a partially closed position and fully closed position, respectively.

As depicted in FIG. 2, the insertion component 300 is in initial engagement with the receiving component 200. As will be described in more detail with reference to FIGS. 4-7 below, the top portion of the insertion component 300 has a smaller cross sectional area than the cross-sectional area of the opening of the receiving component 200. For example, with reference to FIG. 1, the width of the top portion of the insertion component 300, as measured width-wise according to the longitudinal axis 160, may be approximately 60% of the width of the opening of the receiving portion 200 as measured width-wise along the parallel longitudinal axis 162. These proportions are examples, and other proportions may also be used, so long as the relative differences in the widths facilitate guiding of the insertion portion 300 into the receiving portion 200 over a desired range of misalignment.

Once fully inserted into the receiving portion 200, the insertion portion 300 interlocks with the receiving portion 200 by means of cooperative locking structures that are integrally formed in the receiving portion 200 and the insertion portion 300. These locking structures are described in more detail with reference to FIGS. 4-7 below.

As shown in FIG. 3, because the receiving portion 200 rises from the base flange 120, the lid flange 144 is separate from the base flange 120 when the container is in the closed and locked position. This separation facilities air flow around the food product stored inside. However, in other implementations, the receiving portion 200 may instead be a cavity that is formed below a plane defined by the lid flange 200 so that the lid flange 144 and the base flange 120 abut when the container is closed and locked. This configuration can be used for containers that are used to store food product in which free air flow is less important, or even goods that are not food products, such as hardware, toys, etc.

Figure 4:
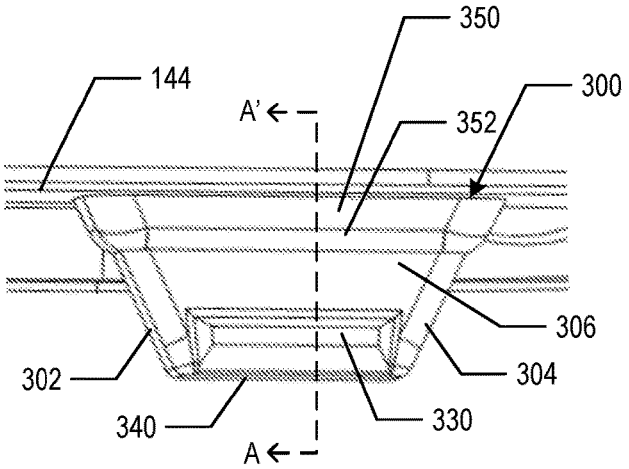
FIG. 4 is a side view of an insertion locking component.

FIGS. 4-7 depict an example implementation of the locking apparatus. Turning now to FIG. 4, a side view of the insertion locking component 300 is illustrated. The insertion locking component 300 is defined by sidewalls, e.g., 302, 304 and 306, extending from the lid flange 144 and defining a substantially trapezoidal prism shaped rib. Due to the approximately trapezoidal shape, the cross-sectional area of the insertion locking component 300 defined by the sidewalls (and exclusive of the locking structures 330 and 332) decreases in proportion to the upward extension of the sidewalls relative to the flange 144. A base portion 350 defining a peripheral should 352 may also be formed in the insertion component 300.

The insertion locking component 300 includes at least one locking structure 330. Another, similar locking structure, e.g., locking structure 332, shown in FIG. 6, may be formed on the other side of the insertion component 300. The locking structure 330, in one implementation, is defined by a protrusion 330 that extends longitudinally along the sidewall 306 of the insertion locking component 300 and is lengthwise parallel to the lid flange 144. The protrusion 330 may form flush with the top surface 340 of the insertion component 340, or may be spaced apart from the top surface 340.

Figure 5:
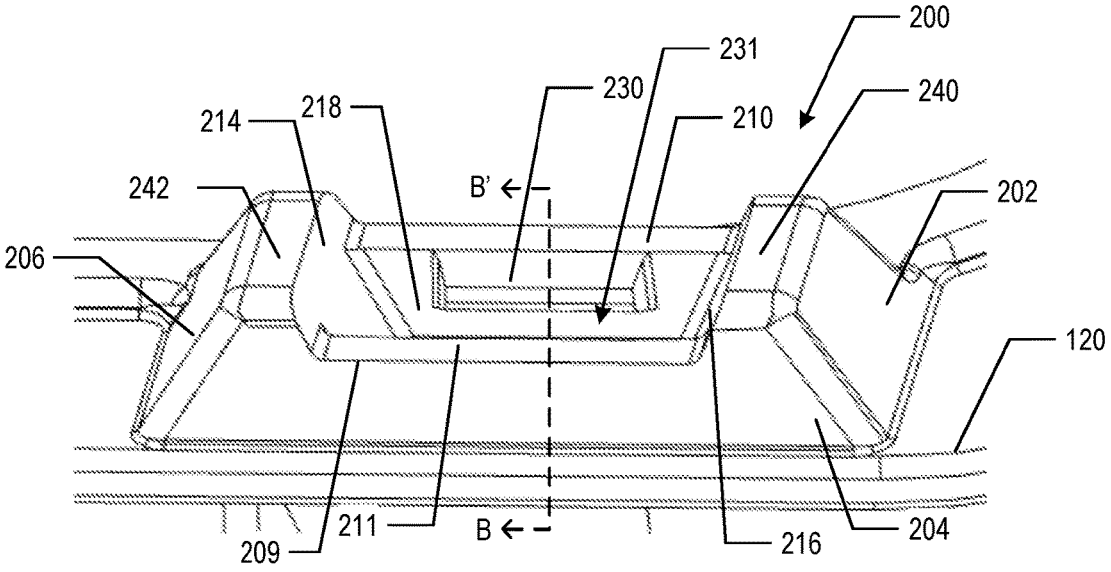
FIG. 5 is a perspective view of a receiving locking component that is operable to receive the insertion locking component.

FIG. 5 is a perspective view of a receiving locking component 200 that is operable to receive the insertion locking component 300. The receiving locking component 200 extends from the base flange 200, and includes outer sidewalls 202, 204 and 206 extending upward from the base flange 120 to form a raised portion relative to base flange 120. The raised portion has receiving surfaces 210 and 211 within a periphery 209 defined by the outer sidewall.

The outer sidewalls 202 and 206 may optionally rise higher than the sidewall 204 (and 208, shown in FIG. 6), resulting in abutting surfaces 240 and 242. Inner sidewalls 214, 216, and 218 (and an additional sidewall opposite 218) extend downward at least from the receiving surface (and the sidewalls 214 and 216 also extend downward from the abutting surfaces 240 and 242, if formed) to form a substantially trapezoidal prism cavity. The cross-sectional area of the trapezoidal prism cavity defined by the inner sidewalls (and exclusive of the locking mechanism 230 and 232) decreases in proportion to the downward extension of the inner sidewalls.

A locking structure 230 in the form of a protrusion defines a recess 231 that extends longitudinally along the sidewall 218 and beneath the protrusion. The protrusion 230 is parallel to the one of the base flange 120. Another locking structure may be provided on the other, opposite sidewall of the receiving component 200 (e.g., protrusion 232, which defines the recess 233 as shown in FIG. 6).

Although a protrusion is used to form the recess, in other implementations, the sidewall 218 may instead have a cavity formed therein. In this implementation, the protrusions 330 and 332 of the insertions component 300 must protrude outward by a slightly longer distance than depicted in FIG. 6.

Figure 6:
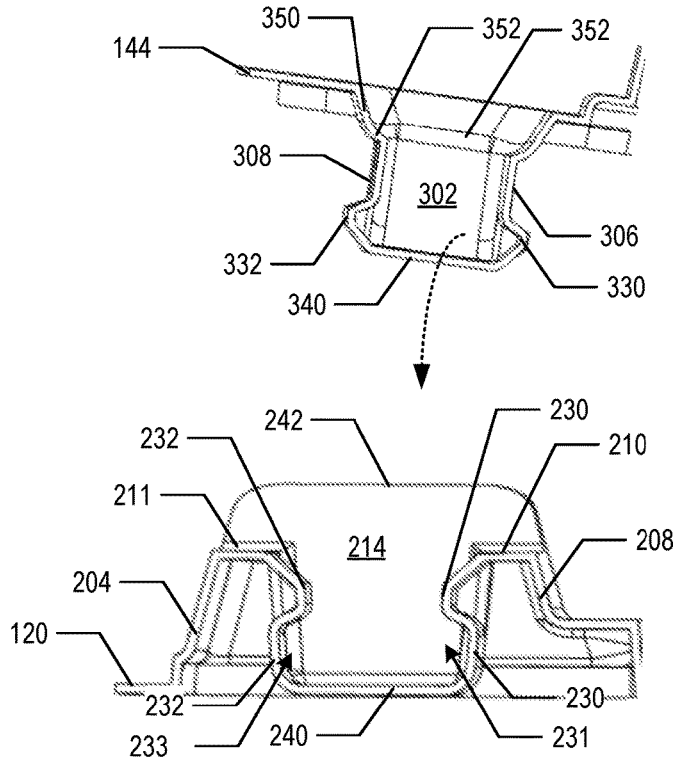
FIG. 6 is a cut view of the insertion locking component being inserted into the receiving locking component

FIG. 6 is a cut view of the insertion locking component 300 being inserted into the receiving locking component 200. The cut view is along the cut lines AA' and BB' of FIGS. 4 and 5, and illustrate the cooperative engagement of the locking structures 330 and 332 with the locking structures 230 and 232. In particular, the locking structures 330 and 332 are operatively associated with the locking structures 230 and 232 so that when the insertion locking component 300 is inserted into the receiving locking component 200 the locking structures 230 and 232 are received in recesses 231 and 233 formed beneath the protrusions 230 and 232.

Figure 7:
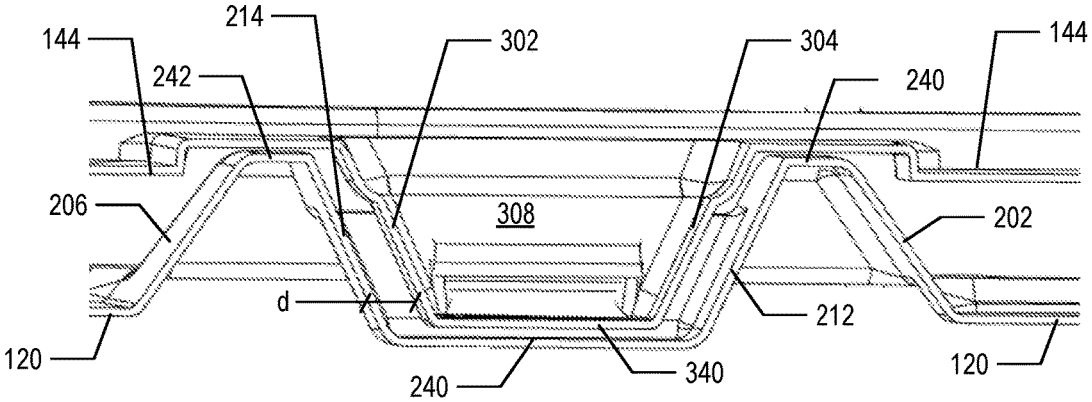
FIG. 7 is a cut view of the insertion locking component fully received into the receiving locking component.

FIG. 7 is a cut view of the insertion locking component 300 fully received into the receiving locking component 200. The cut view is along the horizontal 162 of FIG. 1 when the container 100 is in the closed position. In the implementation shown, the longitudinal width of the insertion portion 300 is smaller than the longitudinal width of the receiving portion 200 such that the walls 302 and 214 are separated by a distance d. Walls 304 and 212 are likewise separated by the same distance. The separation allows for slidable movement of the insertion component 300 relative to the receiving component 200 along the horizontal axis 162. However, the locking structures 330 and 332 and locking structures 230 and 232 are of such horizontal length that they remained interlocked even with the distance d is reduced or even eliminated such that the wall 302 abuts the wall 214. Allowing lateral slidable movement when the locking components 200 and 300 are fully engaged reduces the likelihood of inadvertent separation that might otherwise result if the angular walls of the locking components 200 and 300 were not separated and instead abutted.

Likewise, with reference to FIGS. 4 and 5, because the top surface 340 is substantially smaller widthwise than the opening defined by the receiving surfaces 210 and 211, the insertion locking component 300 may be guided into the opening by the sidewalls 214 and 216. This is enabled by the slideable movement of the insertion locking component 300 along the widthwise longitudinal axis 162 when the top surface 340 of the insertion locking component 300 is flush with the receiving surfaces 210 and 211 of the receiving locking component 200.

In other implementations, the sidewalls 214 and 302, and 212 and 304 may be configured such that they are abutting (e.g., are in direct contact with each other or are so proximate that minor deflection causes direct contact with each other) when the insertion locking component 300 is fully received into the receiving locking component 200.

The abutting surfaces 240 and 242 abut (e.g., are in direct contact with or are so proximate that minor deflection causes direct contact with) the flange 144 when the insertion locking component 300 fully received into the receiving locking component 200.

Figure 10:
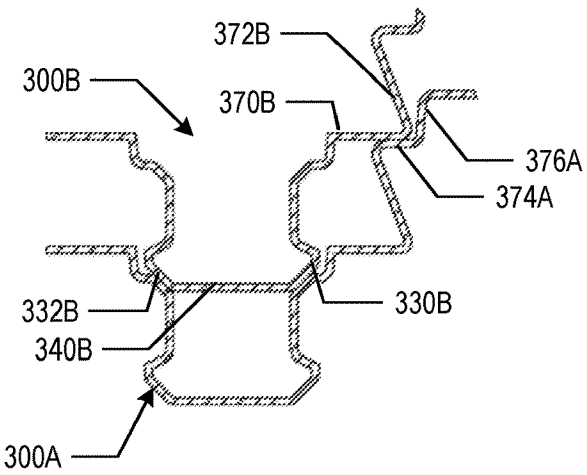
FIGS. 8, 9 and 10 are cut views that show an operation of a de-nesting component proximately formed near the insertion locking component.
Figure 9:
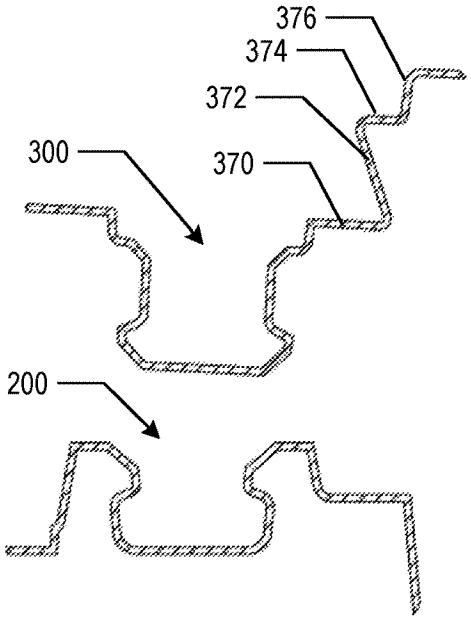
Figure 8:
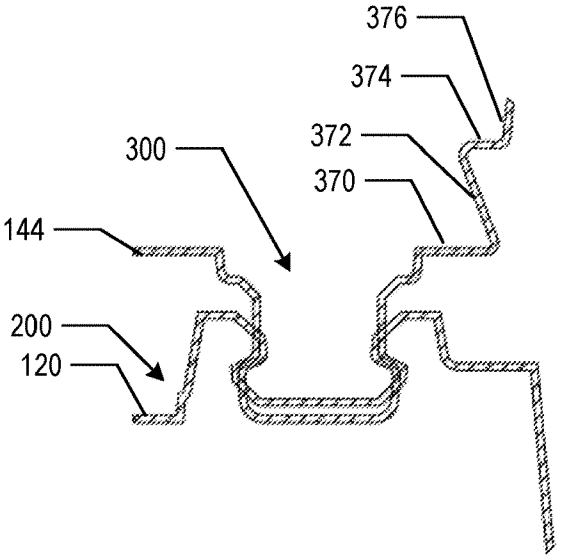

FIGS. 8, 9 and 10 are cut views that show an operation of a de-nesting component proximately formed near the insertion locking component. The de-nesting component forms a lip upon which another de-nesting component rests so as to preclude insertion of a first insertion component 300 into another insertion component 300 when multiple containers 100 are stacked together for storage or shipping.

The de-nesting component is formed by the portions 370, 372, 374 and 376. Base portion 370 provides a base from which the angled component wall portion 372 extends. The angled component wall portion 372 extends from a side of the base portion 370 that is opposite the side of the base portion from which the insertion locking component 300 extends. Wall portion 374 forms a lip surface that extends to an upward wall portion 376.

FIGS. 8 and 9 illustrate the insertion locking component 300 and the receiving locking component 200 when the container is in the closed position and the slightly open position, respectively. Because the wall portions 372, 374 and 376 extend upward relative to the receiving locking component, the wall portions 372, 374 and 376 do not interfere with the locking of the insertion locking component 300 and the receiving locking component 200.

FIG. 10 illustrates how the de-nesting component precludes locking of a first insertion locking component 300A with a second insertion locking component 300B when multiple containers are stacked together. The lip formed by the wall component 374A near a first insertion locking component 300A abuts the base portion 370B near a second insertion locking component 300B. The height of the surface of the lip formed by the wall component 374 A is such that the top surface 340B and the locking structures 330B and 332B of the locking structure 300B cannot penetrate into the interior cavity formed by the locking structure 330A. Thus multiple containers 100 may be stacked for shipment, storage or use in a packaging process without sympathetic interlocking between stacked insertion locking components 300.

The angel formed by the base portion 370 and wall portion 372 may vary so long as the lip formed by the wall portion 374 in a first container 100 is of sufficient length to provide sufficient support to an abutting base portion 370 in a second container.

While this specification contains many specific implementation details, these should not be construed as limitations on the scope of any features or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A container apparatus, comprising:

a base section defining a base surface and one or more sidewalls extending upward from the base surface to define a container portion having an upper base periphery;

a base flange projecting outward from the upper base periphery;

a lid section defining a lid surface and a lid periphery that aligns with the upper base periphery so that the lid surface and the container portion form an enclosure when the lid section is in a closed position relative to the base section; and a lid flange projecting outward from the lid periphery;

wherein the lid flange and the base flange include respectively integrally formed locking components comprising:

a receiving locking component extending from one of the base flange or lid flange, the receiving locking component comprising:

outer sidewalls extending upward from the one of the base flange or lid flange to form a raised portion relative to the one of the base flange or lid flange, the raised portion having a receiving surface within a periphery defined by the outer sidewalls;

inner sidewalls extending downward from the receiving surface to form a substantially trapezoidal prism cavity within the raised portion so that a cross-sectional area of the trapezoidal prism cavity decreases in proportion to the downward extension of the inner sidewalls; and a first locking structure; and an insertion locking component defined by sidewalls extending upward from the other of the base flange or lid flange and defining a substantially trapezoidal prism shaped rib so that a cross-sectional area of the insertion locking component decreases in proportion to the upward extension of the sidewalls, and wherein the insertion locking component includes a second locking structure that is operatively associated with the first locking structure so that when the insertion locking component is inserted into the receiving locking components the first locking structure and the second locking structure interlock;

wherein:

a first outer sidewall and a second outer sidewall opposite the first outer sidewall extend only to the receiving surface;

a third outer sidewalls and a fourth outer sidewall opposite the first outer sidewall of the receiving locking component extend upward above receiving surface and terminate at respective first and second abutting surfaces, wherein the first abutting surface connects to a first inner sidewall and the second abutting surface connects to a second inner sidewall, and wherein the first and second abutting surfaces abut the other of the base flange or lid flange from which the insertion locking component extends.

2. The container apparatus of claim 1, wherein:

the first locking structure is defined by a first protrusion that extends longitudinally along one of the inner sidewalls and lengthwise parallel to the one of the base flange or lid flange; and the second locking structure is defined by a second protrusion that extends longitudinally along one of the sidewalls of the insertion locking component and lengthwise parallel to the other of the base flange or lid flange;

wherein the first locking structure and the second locking structure interlock by a recess formed by the first protrusion and the inner sidewall receiving the second protrusion.

3. The container apparatus of claim 1, wherein:

the first locking structure is defined by a recessed cavity that extends longitudinally along one of the inner sidewalls and lengthwise parallel to the one of the base flange or lid flange; and the second locking structure is defined by a protrusion that extends longitudinally along one of the sidewalls of the insertion locking component and lengthwise parallel to the other of the base flange or lid flange;

wherein the first locking structure and the second locking structure interlock by the recessed cavity receiving the protrusion.

4. The container apparatus of claim 1, wherein the substantially trapezoidal prism cavity is further shaped to substantially match the substantially trapezoidal prism shaped rib of the insertion locking component along a widthwise longitudinal axis so that when the first locking structure and the second locking structure interlock the inner sidewalls along a width of the trapezoidal prism cavity spaced apart from the sidewalls along the width of the insertion locking component to allow slidable movement of the insertion locking component while the first locking structure and the second locking structure are interlocked.

5. The container apparatus of claim 1, wherein:

the receiving locking component extends from the base flange; and the insertion locking component extends from the lid flange.

6. The container apparatus of claim 1, wherein:

the receiving locking component extends from the base flange toward the lid flange; and the insertion locking component extends from the lid flange toward the base flange.

7. The container apparatus of claim 1, wherein:

the receiving locking component extends from the base flange away from the lid flange; and the insertion locking component extends from the lid flange toward the base flange and penetrates a plane defined by the base flange when the first locking structure and the second locking structure are interlocked.

8. A container apparatus, comprising:

a base section defining a base surface and one or more sidewalls extending upward from the base surface to define a container portion having an upper base periphery;

a base flange projecting outward from the upper base periphery;

a lid section defining a lid surface and a lid periphery that aligns with the upper base periphery so that the lid surface and the container portion form an enclosure when the lid section is in a closed position relative to the base section; and a lid flange projecting outward from the lid periphery;

wherein the lid flange and the base flange include respectively integrally formed locking components comprising:

a receiving locking component extending from one of the base flange or lid flange, the receiving locking component comprising:

outer sidewalls extending upward from the one of the base flange or lid flange to form a raised portion relative to the one of the base flange or lid flange, the raised portion having a receiving surface within a periphery defined by the outer sidewalls;

inner sidewalls extending downward from the receiving surface to form a substantially trapezoidal prism cavity within the raised portion so that a cross-sectional area of the trapezoidal prism cavity decreases in proportion to the downward extension of the inner sidewalls; and a first locking structure;

an insertion locking component defined by sidewalls extending upward from the other of the base flange or lid flange and defining a substantially trapezoidal prism shaped rib so that a cross-sectional area of the insertion locking component decreases in proportion to the upward extension of the sidewalls, and wherein the insertion locking component includes a second locking structure that is operatively associated with the first locking structure so that when the insertion locking component is inserted into the receiving locking components the first locking structure and the second locking structure interlock; and a de-nesting component, the de-nesting component comprising:

a base portion extending from a sidewall of the insertion locking component;

an angled component wall portion extending from a side of the base portion that is opposite a side of the base portion from which the insertion locking component extends; and a wall portion extending from the angled wall component to form a lip surface;

wherein when a first and second container apparatus are stacked in an open position the lip surface of the first contain apparatus abuts the base portion of the second container apparatus to preclude insertion of the insertion locking component of the second container apparatus into an opening formed by the insertion locking component of the first container apparatus.

* * * * *